US008789349B1

(12) United States Patent
Drumm

(10) Patent No.: US 8,789,349 B1
(45) Date of Patent: Jul. 29, 2014

(54) BITLESS BRIDLE WITH DOUBLE CROSS UNDER REINSTRAPS

(71) Applicant: Jefferson Aaron Drumm, Signal Mountain, TN (US)

(72) Inventor: Jefferson Aaron Drumm, Signal Mountain, TN (US)

(73) Assignee: Jefferson Aaron Drumm, Signal Mountain, TN (US)

( * ) Notice: Subject to any disclaimer, the term of this patent is extended or adjusted under 35 U.S.C. 154(b) by 3 days.

(21) Appl. No.: 13/733,972

(22) Filed: Jan. 4, 2013

(51) Int. Cl.
*B68B 1/04* (2006.01)

(52) U.S. Cl.
CPC ..... *B68B 1/04* (2013.01); *B68B 2001/042* (2013.01)
USPC ..... 54/6.1

(58) Field of Classification Search
CPC ..... B68B 1/02; B68B 1/04; B68B 2001/042
USPC ..... 54/6.1, 6.2, 24, 85, 12, 13
IPC ..... B68B 1/02, 1/04
See application file for complete search history.

(56) References Cited

U.S. PATENT DOCUMENTS

| | | | | | |
|---|---|---|---|---|---|
| 483,472 | A * | 9/1892 | Peace | ..... | 54/6.2 |
| 3,949,538 | A * | 4/1976 | Woodruff | ..... | 54/24 |
| 4,472,925 | A * | 9/1984 | Woodruff | ..... | 54/24 |
| 4,722,171 | A * | 2/1988 | Meroth | ..... | 54/6.1 |
| 6,591,589 | B2 * | 7/2003 | Cook | ..... | 54/6.1 |
| 2008/0236111 | A1 * | 10/2008 | Brooks | ..... | 54/6.1 |

* cited by examiner

*Primary Examiner* — Son T Nguyen
*Assistant Examiner* — Kathleen Alker

(57) ABSTRACT

A bitless bridle with double cross under reinstraps for riding, driving, and training horses and similar animals that achieves improved control, comfort, and communication with the animal. The bridle is composed of a solid crownpiece that bifurcates, after a brow band attachment, into a cheek strap and an elongated reinstrap. The cheek strap connects to two nosebands which have solid rings attached to each end. The elongated reinstraps cross under the horse's jaw and pass through the first set of rings then cross under the jaw a second time and pass through the second set of rings to continue back to the rider's hands. Pulling on a single reinstrap applies pressure to the horse's nose and poll causing it to turn in the direction pulled. Pulling on both reinstraps cinches the noseband in place, causing the horse to slow down or stop.

1 Claim, 1 Drawing Sheet

BITLESS BRIDLE WITH DOUBLE CROSS UNDER REINSTRAPS

TECHNICAL FIELD

This invention relates to devices for riding, training, driving or quieting horses or other animals.

BACKGROUND INFORMATION

It is known that bridles for riding, driving, and training horses typically control the direction and momentum of the animal by exerting force on a metal bit inserted in the horse's mouth, causing the horse to turn or stop in response to pain, discomfort or pressure of the bit. When the rider or driver applies pressure to a single rein, the bit is pulled backwards into the horse's mouth and against the tongue, gums and lips causing the horse to turn in the direction of the pull in an effort to lessen the discomfort. When the rider or driver applies pressure to both reins, the bit applies pressure against the tongue, gums and lips, causing the horse to slow down or stop. Bridles with bits can cause pain to the horse and create an adverse relationship. In many cases, the pain of the bit can cause horses to become agitated or even run away. A bit in the horse's mouth can also lead to lacerations of the tongue, tooth pain and severe bruising to the gums and underlying bone.

Various bitless bridles exist which affect the control of turning, slowing, or stopping, in a similar manner as bridles with bits, by transferring pressure from a person's hands on reins or driving lines (referred to hereafter as reins) to specific points on the horse's nose or head. Many different configurations have been created which apply patterns of pressure points and thus affect the impact of the bridle upon the horse.

The current invention is composed of five component pieces (constructed from either leather or a woven or solid fiber such as nylon or cotton) which create its unique structure and function:

1. A crownpiece section over the horse's poll which bifurcates on each side.
2. A browband that connects to each side of the crownpiece before the bifurcation.
3. A cheek strap on each side of the horse's face, starting at the crownpiece bifurcation that connects to,
4. A set of two nosebands which terminate in metal circular rings (four rings total) on either side of the horse's nose.
5. A set of elongated reinstraps, one on each side of the horse's head, beginning at the crownpiece bifurcation, which cross under the horse's jaw and run through the first set of rings, then cross under the horse's jaw again and pass through a second set of rings and connect directly to the reins and thus the rider's hands.

In a 2002 US Patent Application 2002/0148207, Cook discloses a bitless bridle that composes an elongated strap connected to a centerpiece at the poles and two crossover reinstraps at the sides and attachable to a pair of reins providing a link between the centerpiece and the reins. Differences in structure between the current invention and Cook's bridle alter the pattern of pressure points and thus affect the ultimate effect that each bridle produces on a horse.

1. Where the current invention has a solid, smooth crownpiece over the horses' poll which bifurcates after the browband into an elongated reinstrap and cheek strap, Cook's bridle uses a crownpiece with a plurality of holes where studs or protuberances may be mounted on the inner surface in combination with a second separate crownpiece that also passes over the poll and is a continuation of the reinstraps. With Cook's bridle, when pressure is applied to the reins attached to the bridle's reinstraps, pressure is transferred to the rings of the noseband and to the reinstrap on the opposite side of the head with significant pressure transferred to the crownpiece over the poll. In Cook's bridle the reinstraps are a continuous piece which passes over the pole and if excessive pressure is applied to one rein, the reinstraps may slip around the horse's head and become uneven with more reinstrap on one side than the other. In the current invention, the reinstrap terminates at the bifurcation after the browband, allowing each reinstrap to maintain an equal length on each side of the horse's head.
2. Where an integral part of the current invention are two nosebands which terminate in solid circular rings on the side of the horse's nose. This creates a different pattern of pressure points. Cook's bridle differs in that it has only one noseband with rings.
3. Where the current invention has a set of two reinstraps beginning at the crownpiece bifurcation, which cross under the jaw and pass through the first set of rings then cross under the jaw again and pass through the second set of rings to connect to the reins and thus the rider's hands. Cook's bridle has a set of elongated reinstraps similar to the current invention where the straps cross under the horse's jaw only once and pass through a set of rings and then continue on to the reins. The function of the reinstraps crossing under the jaw creates a noose or a cinch which anchors the bridle on the horse's face when a rein is pulled. The difference between Cook's bridle and the current invention is the application of a second set of rings on a second noseband. This second noseband and second set of rings allow the reinstraps to cross under the jaw a second time, creating second noose or cinch point under the horse's jaw. In the current invention, a new pattern of pressure points is created. For example, when the right rein is pulled, pressure is transferred first to the ring on that side (first noseband), then to the ring on the opposite side of the nose (second noseband) and then up to the right side of the poll. Cook's bridle, having only one noose or cinch point under the horse's jaw, has a different pattern of pressure points beginning at the ring on the side of the nose then transferring significant pressure up to the opposite side of the poll. When a single rein is pulled on Cook's bridle, the pressure points create a twisting action at the noseband, which is counteracted by a separate strap which cinches around the nose and is connected to the noseband, referred to hereafter as a chinstrap. The current invention eliminates the need for a chinstrap because the second noseband and thus second cinch point under the horse's jaw anchors the bridle in place.

In a 2008 US Patent Application 2008/0236111, Brooks discloses a bitless bridle that may be placed on an animal such as a horse where the bridle exerts substantial pressure on the nose and poll of the animal when the reins are pulled. The bridle includes a solid crownpiece and attached browband, cheek straps, elongated reinstraps and a crossover reinstrap stabilizer. Differences in structure between the current invention and Brook's bridle alter the pattern of pressure points and thus affect the ultimate effect that each bridle produces on a horse.

1. The crownpiece, browband, and cheek straps of these and most bridles are similar.
2. The elongated reinstraps are similar and cross under the horse's jaw.
3. Where an integral part of the current invention is a second noseband with solid circular rings attached to the ends. Brooks bridle has no such comparable feature.

Brook's distinguishing features are a textured noseband and a crossover reinstrap stabilizer located under the horse's jaw. The purpose of Brook's textured noseband and reinstrap stabilizer are to reduce the tendency of the bridle to twist on the nose when a single rein is pulled and to reduce the force transferred to the horse's poll. The current invention eliminates the twisting action of the bridle and reduces the force transferred to the poll through the integration of a second noseband and set of rings which allow the reinstraps to cross under the horse's jaw a second time creating a second noose or cinch point under the jaw. The pressure points acted upon by the current invention differ from those acted upon by Brook's bridle. In the current invention, when a person's hand pulls on a rein attached to the bridle's reinstraps, pressure is transferred to the ring of the first noseband, to the opposite ring of the second noseband, then to the reinstrap and poll on the side from which the rein was pulled, transferring minimal pressure to the solid crownpiece over the poll.

4. Where the current invention eliminates the need for a chinstrap on the underside of the jaw to secure the noseband in place. In the current invention, the nosebands are secured in place through the cinching action of the reinstraps under the jaw. Brook's bridle differs because it employs a chinstrap to secure the noseband.

BRIEF SUMMARY OF THE INVENTION

The present invention is composed of a solid crownpiece that bifurcates on each side of the horse's head, after a brow band attachment, into a cheek strap and an elongated reinstrap. The cheek strap connects to two nosebands which have solid rings attached to each end. The elongated reinstraps cross under the horse's jaw and pass through the first set of rings then cross under the jaw a second time and pass through the second set of rings to continue back to the rider's hands. Pulling on a single reinstrap applies pressure to the first ring on the horse's nose, then to the second ring on the opposite side of the nose, then to the poll causing it to turn in the direction pulled. Pulling on both reinstraps cinches the noseband in place, causing the horse to slow down or stop.

Technical Problems Addressed

I have found that similar bitless bridles have the disadvantage of allowing the noseband to slip on the horse's nose when a single rein is pulled. When the noseband slips, the entire bridle shifts position on the horse's head causing unnecessary discomfort and distraction to the horse. The current invention addresses this issue through the integration of a second noseband with attached rings. This second noseband allows the elongated reinstraps to cross under the horse's jaw a second time, creating a second noose or cinch point under the jaw, which stabilizes the bridle on the horse's nose. This design improvement also eliminates the need for a chinstrap to secure the nosebands in place, a feature unique to this design.

BRIEF DESCRIPTION OF THE DRAWINGS

A preferred embodiment of the invention is illustrated in the accompanying drawings in which.

DETAILED DESCRIPTION OF THE ILLUSTRATED EMBODIMENTS

Figure 2:
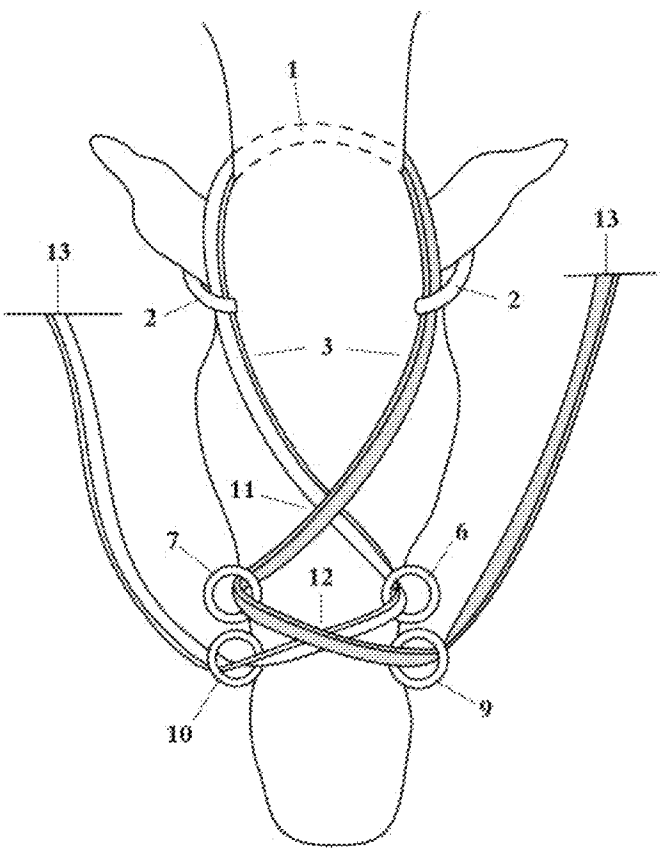
FIG. 2 is a bottom view of the horse's head as seen from directly under the horse's jaw.
Figure 1:
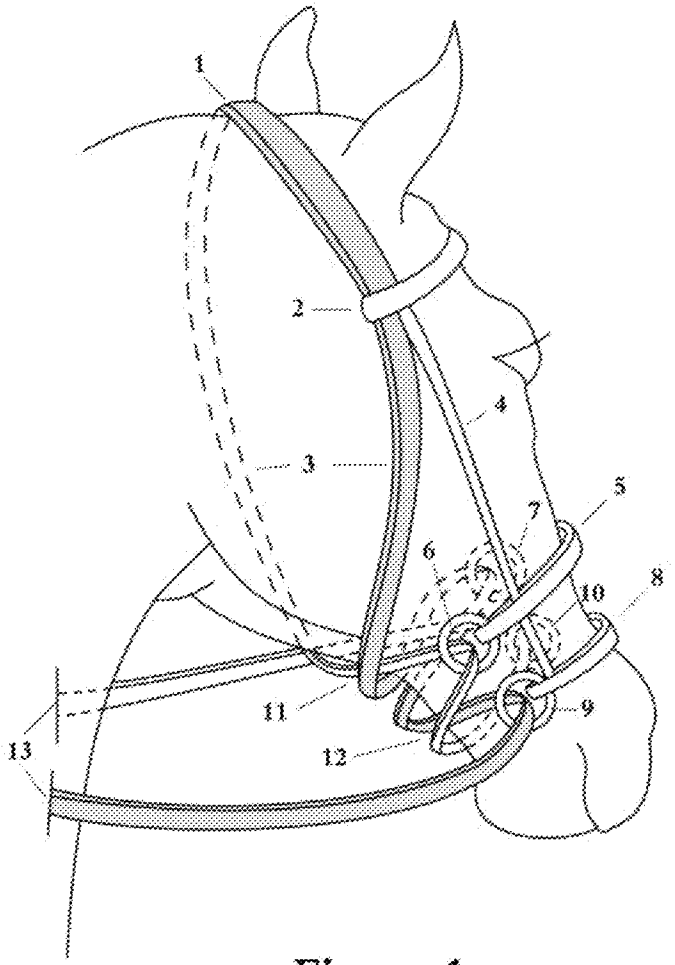
FIG. 1 is a perspective view showing the bridle on the head of a horse with the right reinstrap shaded for clarity.

FIGS. 1 and 2 show the improved bitless bridle and the components which make it up. The present invention is composed of a solid crownpiece 1 that bifurcates on each side of the horse's head, after a brow band attachment 2, into an elongated reinstrap 3 and a cheek strap 4. The cheek strap 4 connects to two nosebands 5 and 8 which have solid rings 6, 7, 9, 10 attached to each end. The elongated reinstraps 3 cross under the horse's jaw at 11 and pass through the first set of rings 6 and 7 then cross under the jaw at 12 a second time and pass through the second set of rings 9 and 10 to continue back to the rider's hands 13.

The bridle components 1, 2, 3, 4, 5, 8, are made from either leather or a woven fiber such as nylon or cotton. The solid rings 6, 7, 9, 10 can be in any geometric shape (although circular seems to be the most efficient) and made from any material as long as the rings can withstand substantial pressure and the reinstraps are able to freely pass through them. Also, the bridle components can be either sized to the horse or buckle adjustments can be added to provide a wide range of sizing options.

I claim:

1. A bitless bridle for a horse having a head and a jaw, the bridle comprising:

a solid crownpiece with two ends, each end bifurcating into a cheek strap and an elongated reinstrap;

a brow band attached to the two ends of the solid crownpiece before the bifurcations; and a first noseband and a second noseband, each of the first and second nosebands having two ends and a solid circular ring attached to each end;

wherein each cheek strap connects to both the first and second nosebands; and wherein at least one of said elongated reinstraps having a first section configured to be on one side of the horse's head and at least the other of said elongated reinstraps having a second section configured to be on the other side of the horse's head, the first section and the second section cross each other at a first crossing point, the first crossing point is configured to be located under the horse's jaw; said first section passes through the solid circular ring of the first noseband on a first side to the solid circular ring of the second noseband on a second side; the second section passes through the solid circular ring of the first noseband on the second side to the solid circular ring of the second noseband on the first side such that the first and second sections cross each other at a second crossing point, the second crossing point is configured to be located under the horse's jaw.

* * * * *